United States Patent [19]

Langenbeck

[11] Patent Number: 4,593,816

[45] Date of Patent: Jun. 10, 1986

[54] CONTAINER FOR STORING AND TRANSPORTING LETTER MAIL AND OTHER FLAT ARTICLES

[76] Inventor: Keith A. Langenbeck, 3112 Purdue St., Dallas, Tex. 75225

[21] Appl. No.: 771,825

[22] Filed: Sep. 3, 1985

[51] Int. Cl.[4] ..... B65D 85/00

[52] U.S. Cl. ..... 206/425; 220/20; 220/72; 206/555; 206/558; 206/564

[58] Field of Search ..... 220/20, 72; 206/555, 206/449, 425, 558, 561, 564

[56] References Cited

U.S. PATENT DOCUMENTS

| | | | |
|---|---|---|---|
| 3,370,701 | 2/1968 | Acker et al. | 206/425 |
| 3,521,788 | 7/1970 | Kandel et al. | 220/72 |
| 3,563,445 | 2/1971 | Clayton | 220/72 |
| 3,659,741 | 5/1972 | Corelli | 220/72 |
| 3,674,132 | 7/1972 | Loss | 220/20 |
| 3,901,406 | 8/1975 | Kivett | 220/72 |
| 4,479,684 | 10/1984 | Doyel | 206/425 |

*Primary Examiner*—Joseph Man-Fu Moy
*Attorney, Agent, or Firm*—W. Kirk McCord

[57] ABSTRACT

A container for storing and transporting letter mail and other flat articles, comprising a pair of side walls, a pair of end walls, a bottom member and a rim member extending outwardly from the side walls and end walls along the perimeter of the container, which are integrally formed as a unit. The side walls, end walls and bottom member define an enclosure for receiving articles. A removable cover member is provided for being positioned substantially in registration with the bottom member to cover the enclosure and protect the contents of the container. The container is preferably comprised of a lightweight material and manufactured using a thermoforming process. Rib members are disposed at pre-determined positions on the side walls, end walls, bottom member and cover member to provide structural integrity for the container. Adjacent ones of the rib members cooperate to form slots for receiving complementary rib members on another container so that the containers are nestable when empty with the respective cover members removed and stackable with the respective cover members positioned on top of the respective containers. The slots between adjacent rib members are adapted to receive dividers to separate letters according to their respective destinations.

31 Claims, 18 Drawing Figures

CONTAINER FOR STORING AND TRANSPORTING LETTER MAIL AND OTHER FLAT ARTICLES

FIELD OF THE INVENTION

The present invention relates generally to containers and particularly to a container for storing and transporting letter mail and other flat articles.

BACKGROUND OF THE INVENTION

In an article conveying and sorting system, such as that used by the U.S. Postal Service to convey and sort mail, individual letters are loaded into containers on the conveyor system according to their respective zip code destinations. The containers are then transported by air or truck to the destination and the letters are fine sorted and distributed to individual letter carriers for delivery to the respective addressees. To ensure efficient handling of such letter mail, the individual containers should be substantially filled to their respective capacities, which necessitates the use of containers having sufficient structural strength to withstand the weight of the letters contained therein and yet being sufficiently light for optimum handling and transportation of the containers. Furthermore, the containers should have the capability of preserving the pre-sort of the mail into groups (preferably by destination) during transit to the destination so that the individual letters are not intermingled.

DESCRIPTION OF THE PRIOR ART

According to prior practice, containers for storing and transporting letter mail are typically comprised of one of the following three types of containers: (1) corrugated plastic tray; (2) injection molded plastic tray; or (3) a corrugated paper tray with or without a corrugated paper sleeve. The heaviest of these three types of containers is usually the injection molded plastic tray, which may weigh as much as 4 pounds. The corrugated paper tray and sleeve typically weigh in the order of 2 pounds and the corrugated plastic tray typically weighs on the order of 1 pound. Letter mail is loaded into these containers according to the respective destinations of the letters. The letters are typically divided into individual groups within each container by strapping or bundling the individual groups.

After the letters are placed in the individual containers, tops or sleeves are placed on the respective containers and strapped to secure the containers. If tops are not utilized, the containers may be "shrink-wrapped" to secure the contents. To conserve space in the transport vehicle, whether by airplane or truck, the containers are usually stacked vertically. Because such prior art containers typically do not have complementary seating surfaces, stacking of the containers is limited due to lack of stability of the container stack. The need therefore exists in the art for a container for storing and transporting letter mail and other flat articles, which is lightweight and yet structurally strong to handle heavy loads of mail, to reduce the cost of and enhance the efficiency of mail handling and transportation.

OBJECTS OF THE INVENTION

It is therefore the principal object of the present invention to provide an improved container for storing and transporting letter mail and other flat articles.

It is another object of the present invention to provide a lightweight yet structurally strong container for storing and transporting letter mail.

It is yet another object of the invention to provide a durable and reusable container for storing and transporting letter mail.

It is still another object of the invention to provide a container for storing and transporting letter mail, which has the capacity to receive a divider to maintain the integrity of pre-sorted groups of letter mail during handling and transportation.

It is a further object of the present invention to provide containers for storing and transporting letter mail which are nestable when empty with the respective covers removed and stackable in a stable vertical configuration when full with the respective covers positioned thereon.

It is yet a further object of the invention to provide a translucent container for storing and transporting letter mail to enable mail handlers to quickly and accurately estimate the relative amounts of mail stored in individual containers.

It is still a further object of the invention to provide a container for storing and transporting letter mail, having a removable cover for securing the container and protecting the contents thereof.

It is still a further object of the invention to provide a container and cover in which the top portion of the cover mates with the bottom portion of the container to stabilize a stacked arrangement of covered containers in both the longitudinal and transverse directions.

SUMMARY OF THE INVENTION

These and other objects are accomplished in accordance with the present invention wherein a container for storing relatively flat articles, such as letters and the like, is comprised of a bottom member and four walls extending upwardly from the bottom member and interconnected to form an enclosure for receiving the articles; a first set of rib members extending vertically along substantially the entire height of a first one of the walls, horizontally across the bottom member and vertically along substantially the entire height of a second one of the walls oppositely positioned from the first wall; a second set of rib members extending vertically along substantially the entire height of a third wall and partially inwardly along the bottom member and terminating at respective intersections on the bottom member with a particular one of the first set of rib members which is closest to the third wall; a third set or rib members extending vertically along substantially the entire height of a fourth wall oppositely positioned from the third wall and partially inwardly along the bottom member, the third set of rib members terminating at respective intersections on the bottom member with a particular one of the first set of rib members which is closest to the fourth wall; and a rim member extending longitudinally outward from the four walls around the perimeter of the container.

In one aspect of the invention the container includes a removable cover member for covering the enclosure of the container to protect articles stored therein. The cover member is comprised of a base portion, four walls extending upwardly from the base portion and a lip member extending horizontally outward from the walls around the perimeter of the cover member for being positioned in facing contact with the rim member when the cover member is positioned to cover the enclosure of the container. The cover member further includes a fourth set of rib members extending vertically along substantially the entire height of a fifth wall, horizontally across the base portion and vertically along substantially the entire height of a sixth wall oppositely positioned from the fifth wall; a fifth set of rib members extending vertically along substantially the entire height of a seventh wall and partially inwardly along the base portion and terminating at respective intersections on the base portion with a particular one of the fourth set of rib members which is closest to the seventh wall; and a sixth set of rib members extending vertically along substantially the entire height of an eighth wall and partially inwardly along the base portion and terminating at respective intersections on the base member with a particular one of the fourth set of rib members which is closest to the eighth wall. The fourth, fifth and sixth sets of rib members are complementary with the respective first, second and third sets of rib members and are in registration therewith when the cover member is positioned to cover the enclosure of the container. In one embodiment the rim member has a first pair of openings formed therein adjacent to respective central portions of the container of each of the four walls of the container and the lip member has a corresponding second pair of openings formed therein adjacent to respective central portions of each of the four walls of the cover member. Each of a second pair of openings is substantially in registration with a corresponding first pair of openings for receiving a tie member or the like for securing the rim member to the lip member.

In another aspect of the invention selected ones of the rib members of the container cooperate to define respective slots therebetween for receiving divider means for partitioning the container into selected compartments to maintain the integrity of the pre-sorted articles stored therein. In one embodiment the first set of rib members extends vertically along substantially the entire height of a first side wall of the container, transversely across the bottom member and vertically along substantially the entire height of a second, oppositely positioned side wall. Adjacent ones of the first set of rib members cooperate to define respective slots therebetween for receiving divider means. In another embodiment the first set of rib members extends vertically along substantially the entire height of a first end wall of the container, longitudinally along the bottom member and vertically along substantially the entire height of a second, oppositely positioned end wall of the container. The second and third sets of rib members extend vertically along substantially the entire heights of respective first and second side walls of the container and partially inwardly across the bottom member and terminate at respective intersections on the bottom member with respective ones of the first set of rib members which are closest to the respective first and second side walls. Adjacent ones of the second and third sets of rib members cooperate to define respective slots therebetween, which are adapted to receive divider means for partitioning the container into selected compartments.

In yet another aspect of the invention multiple containers are vertically stackable in a stable configuration. In one embodiment the first, second and third rib members are disposed on respective inner surfaces of the container and define corresponding grooves on respective outer surfaces thereof. The fourth, fifth and sixth rib members are disposed on respective inner surfaces of the walls of the cover member and on an upper surface of the base portion of the cover member and define corresponding grooves on the respectve outer surfaces of the walls of the cover member and on a lower surface of the base portion of the cover member. The grooves formed by the first, second and third rib members on a first container mate with respective ones of the fourth, fifth and sixth rib members on the cover member of a second container to allow multiple containers to be stacked. In another embodiment the first, second and third rib members are disposed on respective outer surfaces of the container and define corresponding grooves on respective inner surfaces thereof. The fourth, fifth and sixth rib members are disposed on respective outer surfaces of the walls of the cover member and on a lower surface of the base portion of the cover member and define respective grooves on the respective inner surfaces of the walls of the cover member and on an upper surface of the base portion of the cover member. The first, second and third rib members on a first container mate with respective grooves defined by the fourth, fifth and sixth rib members on a second container to allow multiple containers to be stacked.

In still another aspect of the invention multiple containers are nestable when empty and with the respective cover members removed by inserting the bottom member of a first container into the enclosure of a second container so that the grooves of the first container mate with complementary rib members on the second container. In one embodiment, the first, sescond and third rib members are disposed on respective inner surfaces of the container and define corresponding grooves on respective outer surfaces thereof so that the grooves formed by the first, second and third rib members on a first container mate with respective ones of the first, second and third rib members on the inner surfaces of the second container. In another embodiment the first, second and third rib members are disposed on respective outer surfaces of the container and define respective grooves on respective inner surfaces thereof. The first, second and third rib members on the first container mate with the respective grooves formed by the first, second and third rib members of the second container to allow multiple containers to be nested.

In still another aspect of the invention the first rib members extend vertically along substantially the entire height of a first wall of the container, horizontally across the bottom member and vertically along substantially the entire height of a second, oppositely positioned wall and are disposed on respective inner surfaces of the container. A second set of rib members extends vertically on an outer surface of a third wall along substantially the entire height of the third wall. The second set of rib members is blended into the rim member adjacent to the intersection of the rim member and the third wall and into the bottom member adjacent to the intersection of the bottom member and the third wall. The third set of rib members extends vertically on an outer surface of a fourth wall opposite from the third wall and along substantially the entire height of the fourth wall. The third set of rib members is blended into the rim member adjacent to the intersection of the rim member and the fourth wall and into the bottom member adjacent to the intersection of the bottom member and the fourth wall.

In a preferred embodiment, the container of the present invention is formed using a conventional thermoforming process so that the four walls, bottom member, rim member and first, second and third rib members are formed as an integral unit and the cover member is also formed as an integral unit. The container is preferably comprised of a lightweight, translucent plastic material having a substantially rectangular shape. The respective intersections between adjacent walls of the container, the respective intersections between each of the walls and the bottom member of the container and the respective intersections between each of the walls and the rim member of the container define respective curved surfaces to provide respective areas of transition therebetween to enhance the strength and rigidity of the container. Likewise, the respective intersections between adjacent ones of the walls of the cover member, between each of the walls of the cover member and the base portion and between each of the walls of the cover member and the lip member define respective curved surfaces to provide respective areas of transition therebetween, to enhance the strength and rigidity of the cover member.

The first, second and third rib members blend into the rim member adjacent to the respective intersections of the rim member with the corresponding walls of the container. Likewise, the fourth, fifth and sixth sets of rib members of the cover member blend into the lip member adjacent to the respective intersections of the lip member with the respective walls of the cover member. The respective confluences of adjacent walls of the container and the bottom member of the container form respective lower corners. Each lower corner has a relatively flat first beveled member extending inwardly and downwardly from a predetermined position above the bottom member and terminating on the bottom member adjacent to the corresponding lower corner, for reinforcing the lower corners of the container. Second relatively flat beveled members are disposed between adjacent ones of selected rib members on the container. The second beveled members extend inwardly and downwardly from a predetermined position above the bottom member and terminate on the bottom member adjacent to the respective intersections of the corresponding walls of the container with the bottom member, to reinforce the areas of transition between the corresponding walls and the bottom member.

BRIEF DESCRIPTION OF THE DRAWINGS

Still further objects and advantages of the invention will be apparent from the Detailed Description and Claims when read in conjunction with the accompanying drawings wherein:

DETAILED DESCRIPTION OF THE PREFERRED EMBODIMENTS

Figure 1:
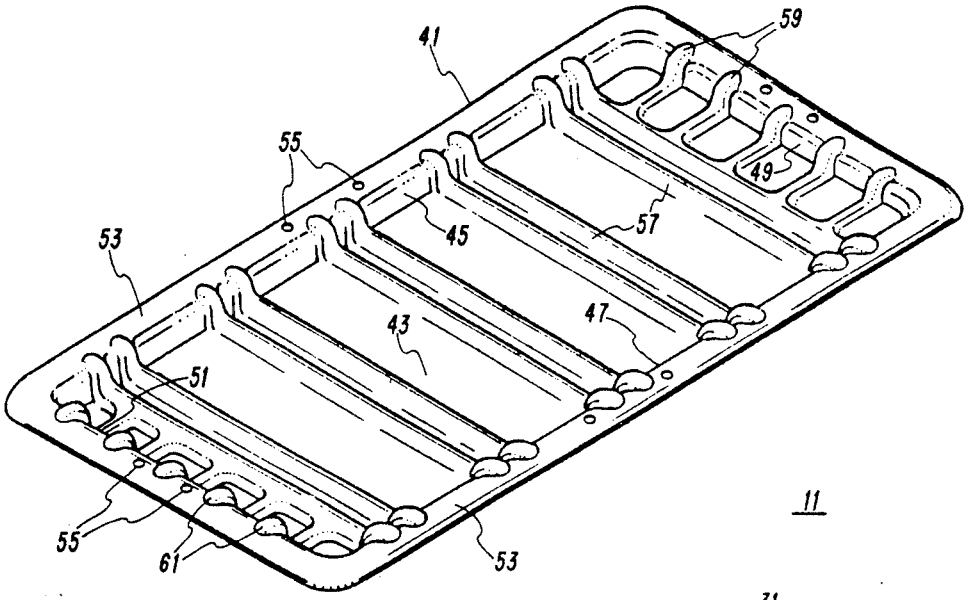
FIG. 1 is a perspective view of a first embodiment of a container for storing and transporting letter mail and other flat articles according to the present invention.
Figure 1:
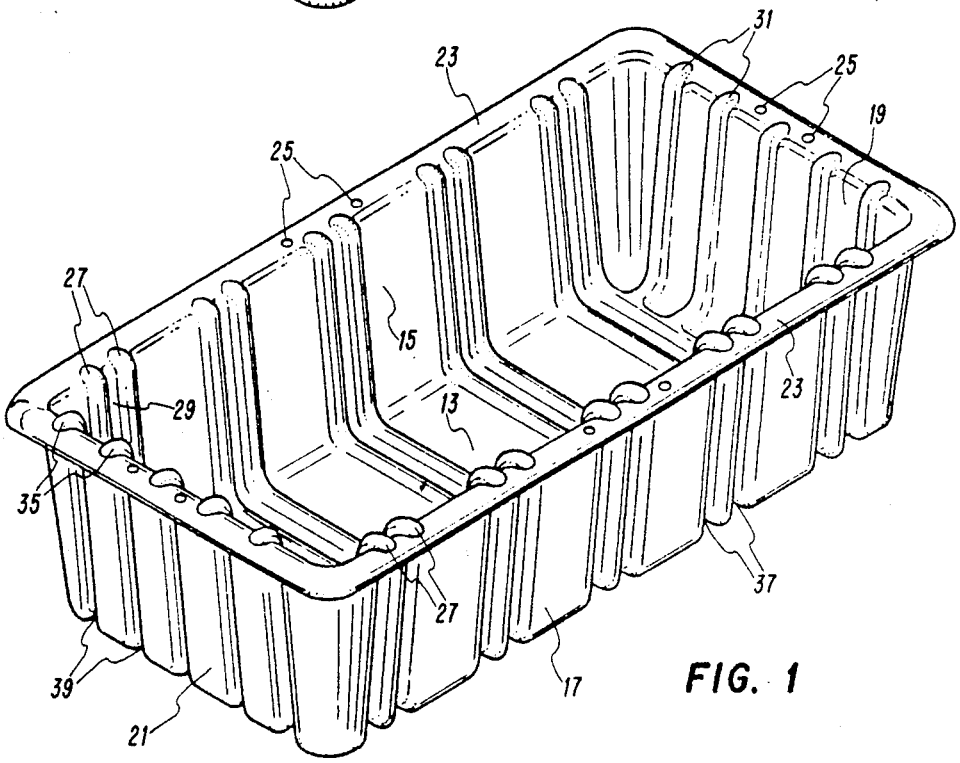

In the description which follows, like parts are marked throughout the specification and drawings, respectively. The drawings are not necessarily to scale and in some instances proportions may have been exaggerated in order to more clearly depict certain features of the invention.

Referring to FIGS. 1, 3, 4, 5, 6 and 7, a first embodiment of a container 11 according to the present invention is comprised of a bottom member 13, a pair of oppositely positioned side walls 15 and 17 and a pair of oppositely positioned end walls 19 and 21, interconnected to form an enclosure for receiving articles therein. Extending horizontally outward from side walls 15 and 17 and from end walls 19 and 21 around the perimeter of container 11 is a rim member 23, the inner portion of which defines a curved surface and the outer portion of which defines a relatively flat surface. Four pairs of openings 25 are disposed on rim member 23, adjacent to the respective central portions of the four walls 15, 17, 19 and 21 of container 11, for receiving a tie member or other device, as will be described in greater detail hereinafter.

Disposed on respective inner surfaces of side walls 15 and 17 and bottom member 13 are a first set of rib members 27. First rib members 27 are arranged in cooperating pairs for defining a slot 29 therebetween. Each pair of rib members 27 is arranged so that the distance between respective slots 29 of adjacent pairs of rib members 27 is substantially equal and is substantially greater than the width of each slot 29, as measured along the longitudinal axis of container 11. First rib members 27 extend substantially along the entire height of side wall 15, transversely across bottom member 13 and substantially along the entire height of opposite side wall 17 and terminate at the respective upper ends thereof by blending into rim member 23 adjacent to the respective side walls 15 and 17.

A second set of rib members 31 is disposed on an inner surface of end wall 19 and extends substantially along the entire height of end wall 19 and partially inwardly along bottom member 13 and terminating at the respective intersections on bottom member 13 with the particular one of the first set of rib members 27 which is closest to end wall 19. Second rib members 31 are spaced apart at substantially equal distances along end wall 19, as measured along the transverse axis of container 11. Second rib members 31 terminate at the respective upper ends thereof by blending into rim member 23 adjacent to the intersection of rim member 23 and end wall 19.

A third set of rib members 35 are disposed on an inner surface of end wall 21, extending substantially along the entire height of end wall 21 and partially inwardly along bottom member 13 and terminating at the intersection on bottom member 13 with the particular one of first rib members 27 which is closest to end wall 21. Third rib members 35 are spaced apart at substantially equal intervals, as measured along the transverse axis of container 11, in much the same manner as second rib members 31 and terminate at the respective upper ends thereof by blending into rim member 23 adjacent to the intersection of rim member 23 and end wall 21. Third rim members 35 are in effect a mirror image of second rib members 31.

Bottom member 13, side walls 15 and 17, end walls 19 and 21, rim member 23 and first, second and third rib members 27, 31 and 35 are formed as an integral unit using a conventional thermoforming process. Container 11 is preferably comprised of a lightweight plastic material, which is translucent to allow the contents thereof to be viewed from the exterior. Each rib member of container 11 forms a corresponding groove in the corresponding outer surface of container 11. First rib members 27 form corresponding grooves 37 in sidewalls 15 and 17 and second and third rib members 31 and 35 form corresponding grooves 39 in respective end walls 19 and 21.

To protect the contents of container 11 during storage and transport, a cover member 41 is provided to cover the enclosure formed by bottom member 13, side walls 15 and 17 and end walls 19 and 21. Cover member 41 is comprised of a base portion 43, a pair of relatively shallow, oppositely positioned side walls 45 and 47 and a pair of relatively shallow, oppositely positioned end walls 49 and 51. A lip member 53 extends horizontally outward from side walls 45 and 47 and from end walls 49 and 51 along the entire perimeter of cover member 41 for being positioned in facing contact with rim member 23 of container 11. The inner portion of lip member 53 defines a curved surface and the outer portion defines a relatively flat surface to complement the respective inner and outer portions of rim member 23. Lip member 53 further includes four pairs of openings 55 formed adjacent to the respective central portions of each of the four walls of cover member 41. When cover member 41 is positioned to cover the enclosure of container 11, openings 55 are in registration with openings 25 in rim member 23 for receiving a tie member to securely attach cover member 41 to container 11, as will be described with reference to FIG. 9.

Cover member 41 further includes fourth, fifth and sixth sets of rib members 57, 59 and 61, which are complementary with respective first, second and third sets of rib members 27, 31 and 35 of container 11. Fourth rib members 57 are disposed on the respective inner surfaces of side walls 45 and 47 and on an upper surface of base portion 43. Fourth rib members 57 extend substantially along the entire height of side wall 45, transversely across base portion 43 and substantially along the entire height of side wall 47 and terminate by blending into lip member 53 adjacent to the respective intersections of lip member 53 with side walls 45 and 47. Fourth rib members 57 are arranged in cooperating pairs in substantially the same manner that first rib members 27 are disposed on container 11.

Fifth rib members 59 extend substantially along the entire height of end wall 49 on the inner surface thereof and partially inwardly along base portion 43 on the upper surface thereof and terminate at the intersection on base portion 43 with the particular one of the fourth set of rib members 57 which is closest to end wall 49. Fifth rib members 59 blend into lip member 53 at the intersection of lip member 53 with end wall 49. Similarly, sixth rib members 61 extend substantially along the entire height of opposite end wall 51 on the inner surface thereof and partially inwardly along base portion 43 and terminate at the intersection on bottom portion 43 with the particular one of the fourth set of rib members 57 which is closest to end wall 51. Fourth, fifth and sixth rib members 57, 59 and 61 form corresponding grooves (not shown) on the outer surfaces of side walls 45 and 47 and end walls 49 and 51 and on the lower surface of base portion 43. Cover member 41 is also formed using a conventional thermoforming process and is preferably comprised of a lightweight, translucent plastic material. Bottom portion 43, side walls 45 and 47, end walls 49 and 51, lip member 53 and rib members 57, 59 and 61 are formed as an integral unit.

Figure 2:
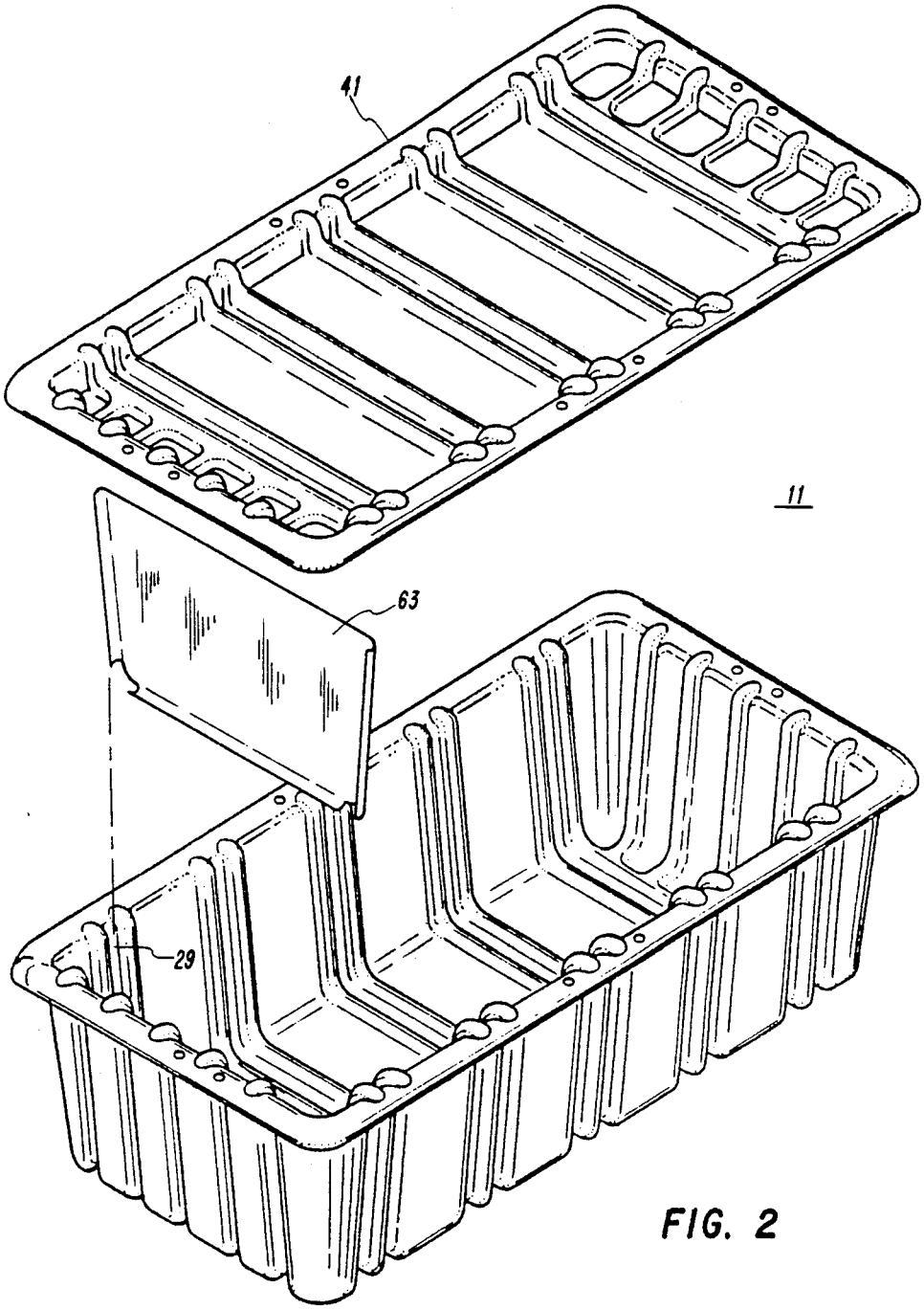
FIG. 2 is a perspective view of the container of FIG. 1, receiving a divider for partitioning the container into two separate compartments.
Figure 3:
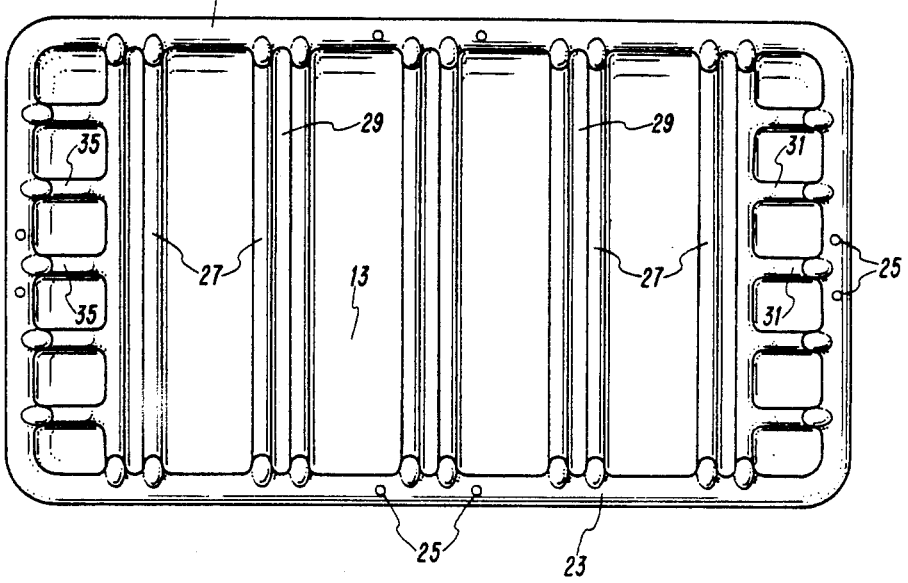
FIG. 3 is a top plan view of the interior of the container shown in FIG. 1.
Figure 4:
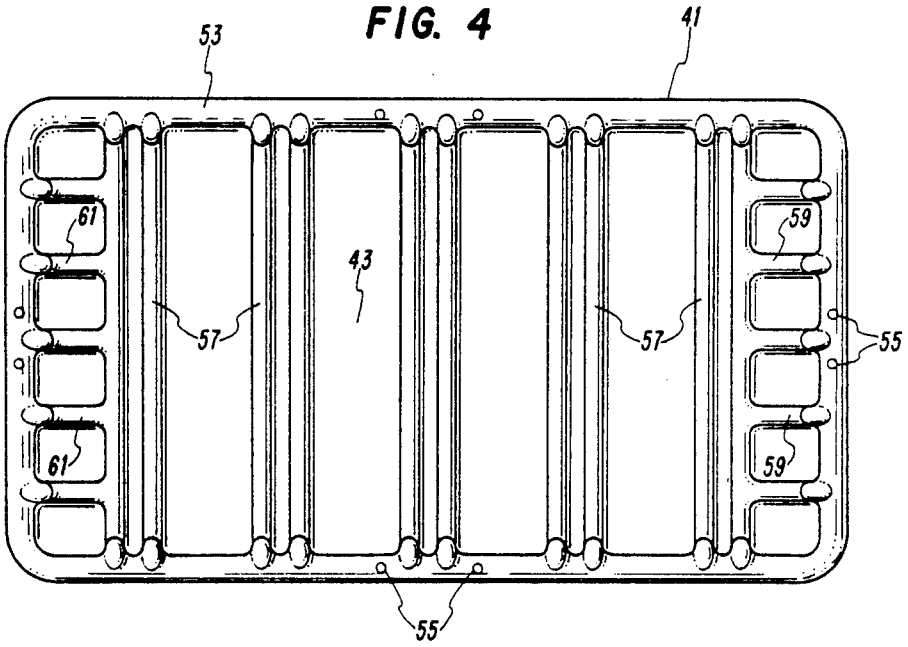
FIG. 4 is a top plan view of the cover member of the container shown in FIG. 1.
Figure 5:
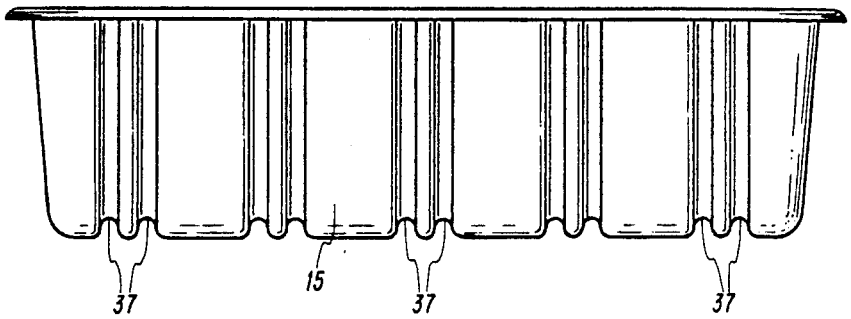
FIG. 5 is a side elevational view of the container shown in FIG. 1.
Figure 6:
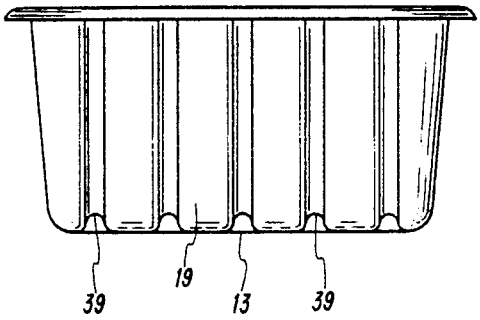
FIG. 6 is an end elevational view of the container shown in FIG. 1.
Figure 7:
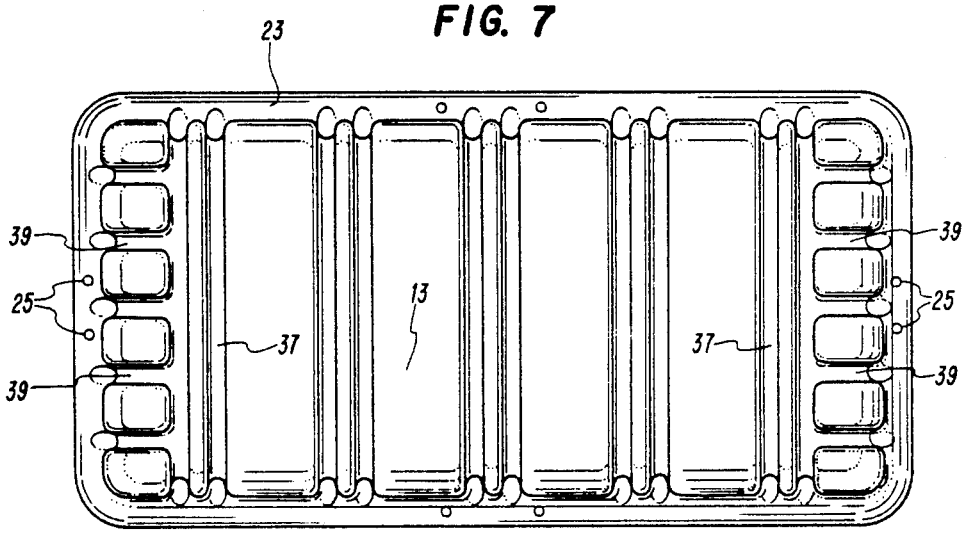
FIG. 7 is a bottom plan view of the container shown in FIG. 1.
Figure 8:
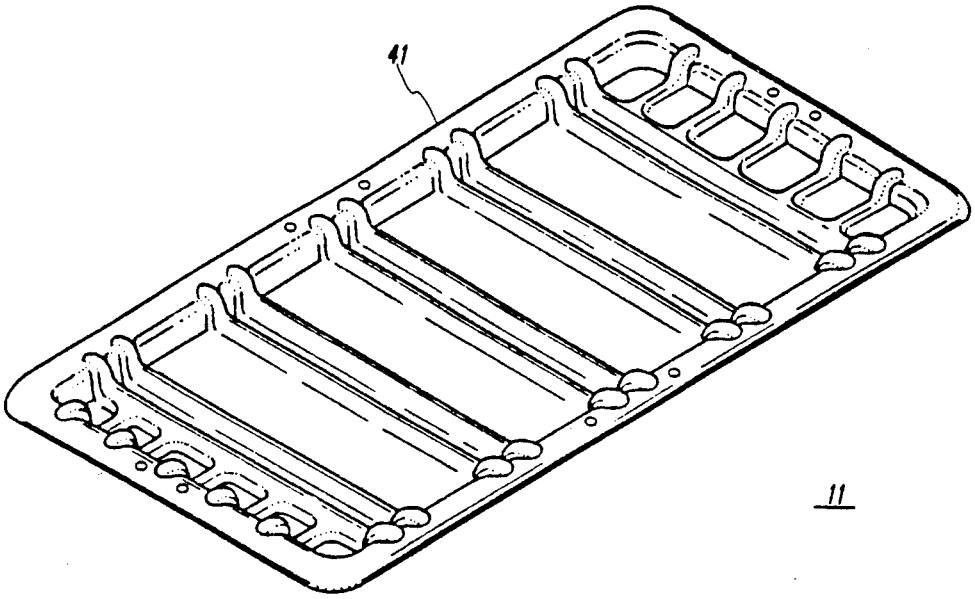
FIG. 8 is a perspective view of the container shown in FIG. 1 with letter mail and divider members disposed therein.
Figure 8:
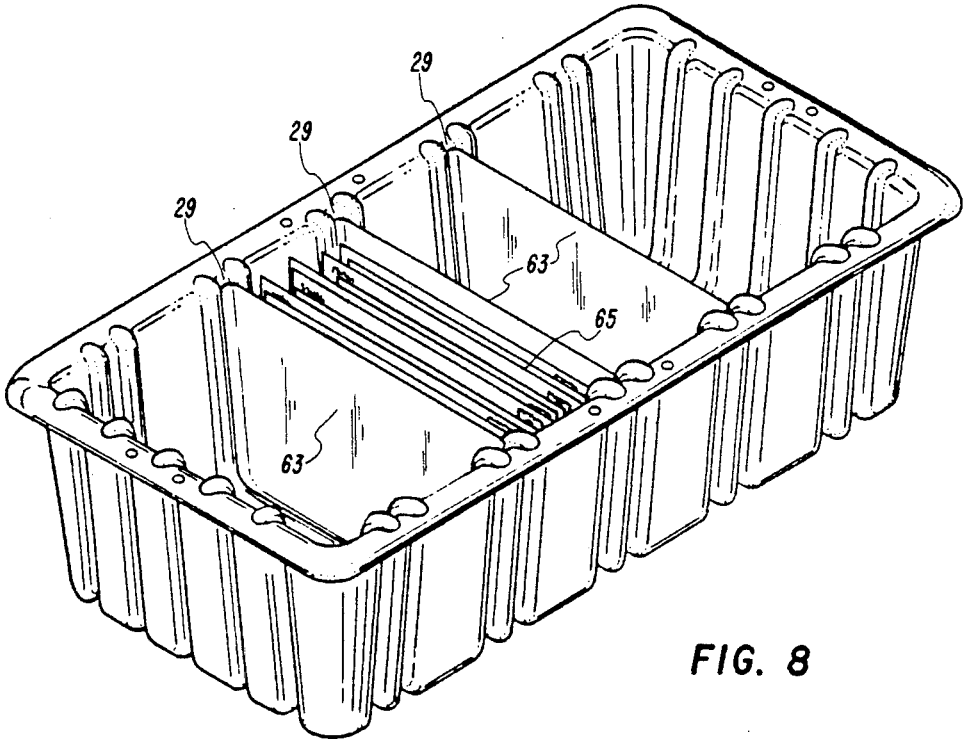

Referring to FIGS. 2 and 8, slots 29 between each cooperating pair of first rib members 27 are adapted for receiving a divider 63 therein, thereby allowing container 11 to be partitioned into selected compartments to maintain the integrity of pre-sorted groups of articles stored therein. For example, when letter mail has been sorted according to destination, one or more dividers 63 may be positioned in container 11 between groups of pre-sorted letter mail or individual letters 65 to prevent commingling thereof during transportation.

Figure 9:
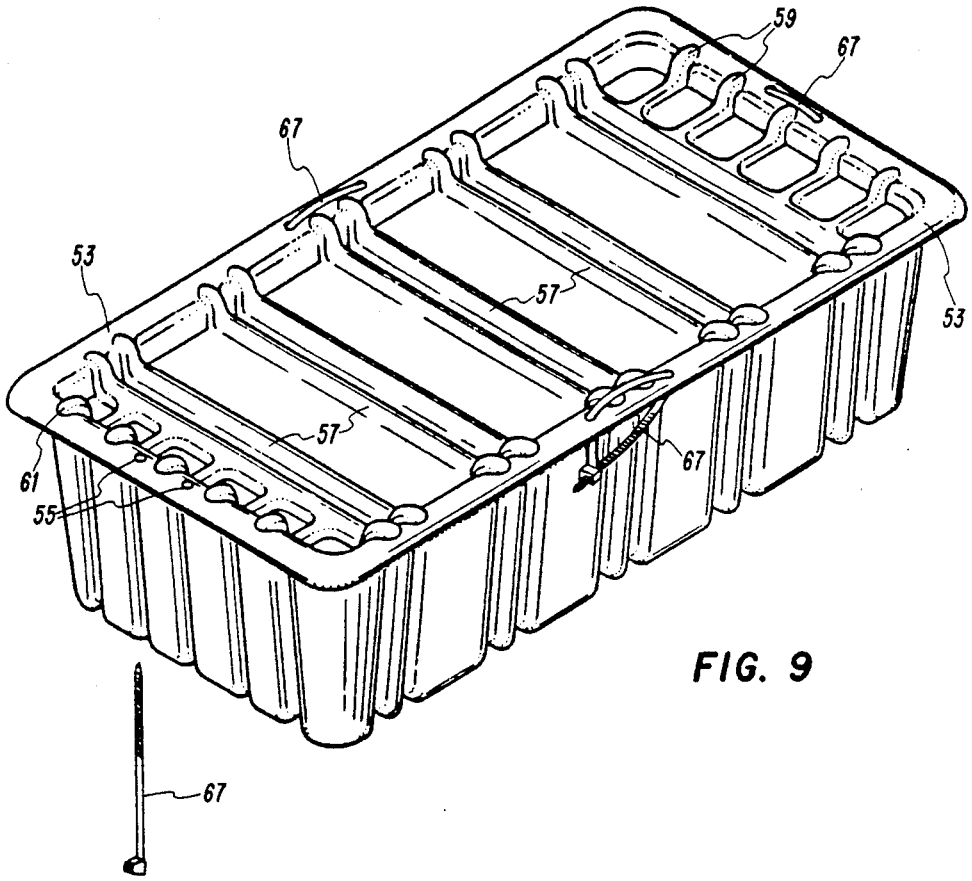
FIG. 9 is a perspective view of the container shown in FIG. 1 with the cover member secured in place on top of the container.

Referring to FIG. 9, container 11 is secured by placing cover member 41 on top of the container enclosure so that the lower surface of lip member 53 is in facing contact with the upper surface of rim member 23 to seal off container 11 and to protect the contents thereof from exposure to the elements. When cover member 41 is so positioned, openings 25 in rim member 23 are in registration with corresponding openings 55 in lip member 53. A tie member 67, which is preferably comprised of a flexible plastic member, is inserted through each pair of aligned openings 25 and 55 and the ends thereof secured together as shown, thereby securely fastening lip member 53 of cover member 41 to rim member 23. The respective upper portions of first rib members 27 adjacent to rim member 23 mate with corresponding grooves formed by fourth rib members 57 on the respective outer surfaces of side walls 45 and 47; the respective upper portions of second rib members 31 adjacent to rim member 23 mate with corresponding grooves formed by fifth rib members 59 on the outer surface of end wall 49; and the respective upper portions of third rib members 35 adjacent to rim member 23 mate with corresponding grooves formed by sixth rib members 61 on the outer surface of end wall 51, to anchor cover member 41 on container 11 and prevent cover member 41 from shifting longitudinally or transversely.

Figure 10:
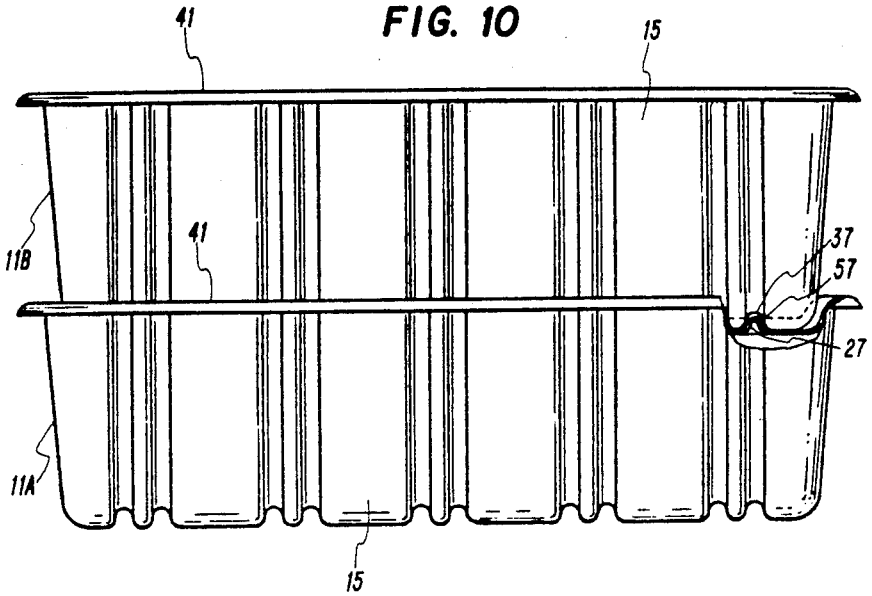
FIG. 10 is a side elevational view of two containers according to the present invention, disposed in a vertical stacking arrangement.
Figure 11:
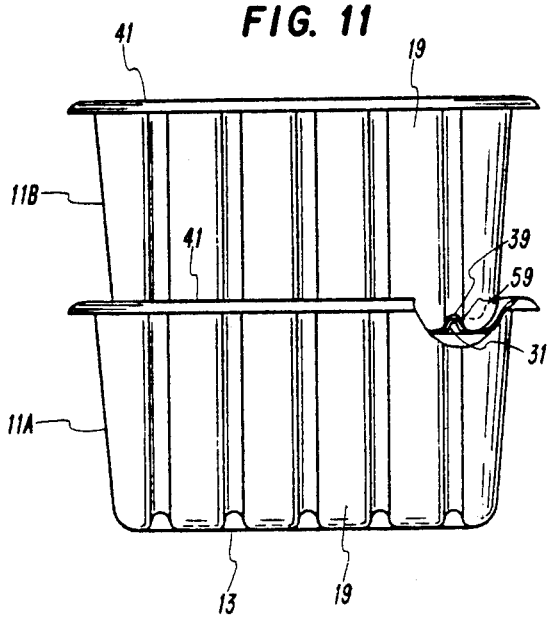
FIG. 11 is an end elevational view of two containers according to the present invention in a vertical stacking arrangement.

Referring to FIGS. 10 and 11, multiple containers 11 may be vertically stacked in a stable configuration to conserve space while containers 11 are being stored or transported. When containers 11 are stacked vertically, grooves 37 formed by first rib members 27 and grooves 39 formed by second and third rib members 31 and 35 on the respective outer surfaces of container 11 mate with corresponding rib members on cover member 41. Grooves 37 mate with fourth rib members 57 and grooves 39 mate with corresponding rib members of fifth and sixth sets of rib members 59 and 61, respectively. In FIG. 10 a partial cut-away view shows a cross-section of a rib member of the fourth set of rib members 57 on the upper surface of base portion 43 of lower container 11A in mating relationship with a groove 37 on the outer surface of bottom member 13 of upper container 11B for preventing the stacked containers 11 from sliding along the longitudinal axis of containers 11. A rib member of the first set of rib members 27 of lower container 11A is shown in mating engagement with a groove defined by rib member 57 on cover member 41 of lower container 11A.

In FIG. 11, a cut-away view shows a rib member of the fifth set of rib members 59 on the upper surface of base portion 43 of lower container 11A in mating engagement with a groove 39 formed by a rib member of the second set of rib members 31 on the outer surface of bottom member 13 of upper container 11B, for preventing the stacked containers 11 from sliding transversely with respect to one another. A rib member of the second set of rib members 31 of lower container 11A is shown in mating engagement with a groove defined by rib member 59 on cover member 41 of lower container 11A. A sixth set of rib members 61 mates with corresponding grooves 39 formed by third rib members 35 on the respective outer surfaces of container 11 in substantially the same manner as illustrated in FIG. 11, to prevent transverse movement of the stacked containers 11 relative to one another.

Figure 12:
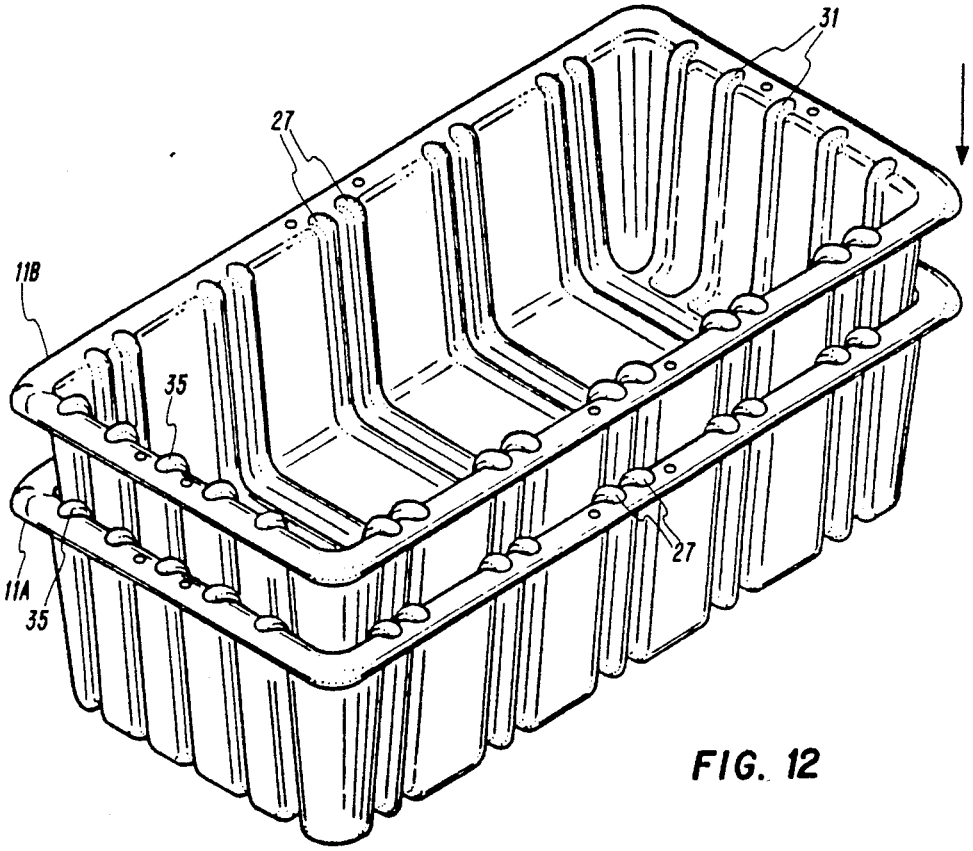
FIG. 12 is a perspective of two containers according to the present invention being nested together while empty and with the respective cover members removed.

Referring to FIG. 12, multiple containers 11 are nestable when empty and with their respective cover members removed. The bottom member of upper container 11B is inserted into the enclosure of lower container 11A so that first set of rib members 27 formed on the respective inner surfaces of container 11A mate with corresponding ones of grooves 37 formed on the respective outer surfaces of container 11B and second and third sets of rib members 31 and 35 disposed on the respective inner surfaces of container 11A mate with corresponding ones of grooves 39 formed on the respective outer surfaces of container 11B to minimize the height of the nested configuration and save storage space.

Figure 13:
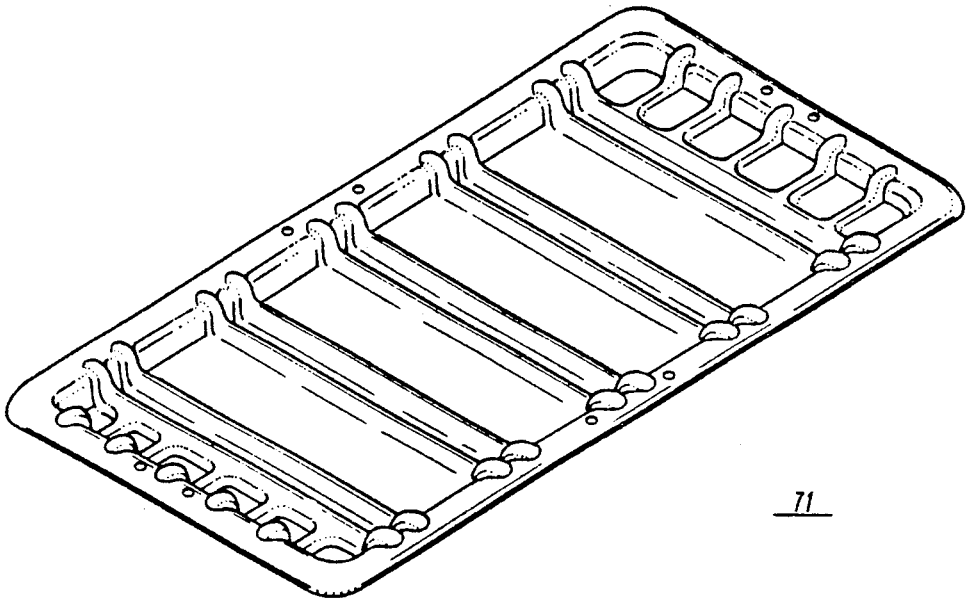
FIG. 13 is a perspective view of a second embodiment of the container according to the present invention.
Figure 13:
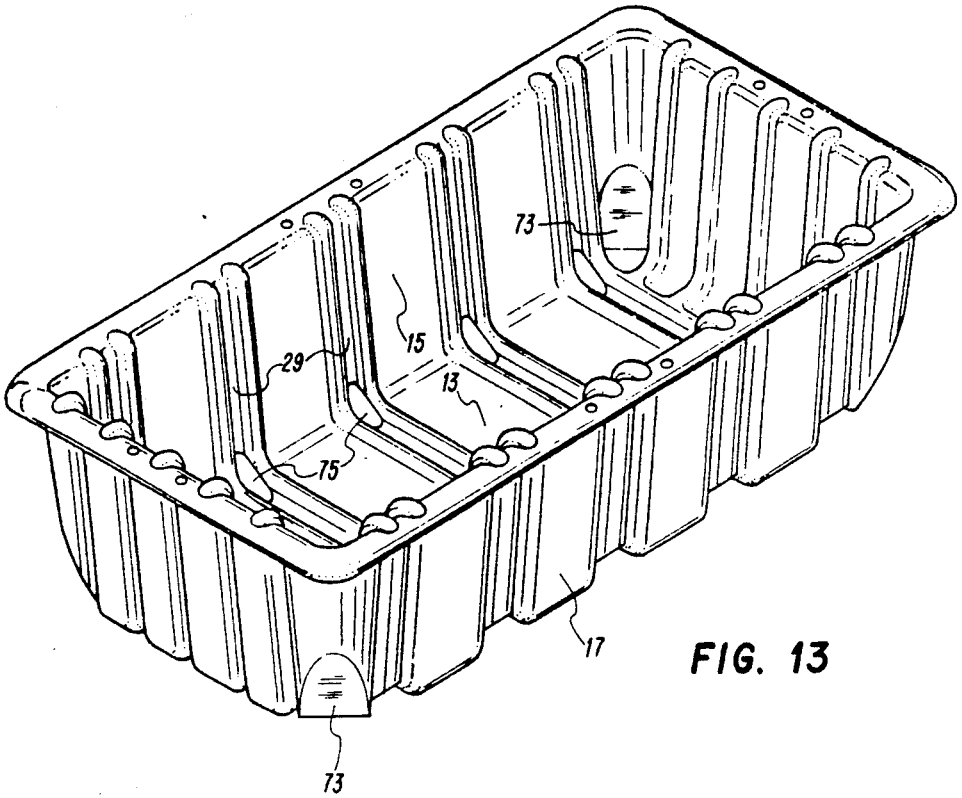

Referring to FIG. 13, a second embodiment of a container 71 according to the present invention is shown. Container 71 is substantially the same as container 11 described above with reference to FIGS. 1–12, except that container 71 includes first and second sets of beveled members 73 and 75 disposed adjacent to the respective intersections of bottom member 13 with the four walls of container 71. First set of beveled members 73 is positioned at the respective four corners of container 71, for reinforcing the lower corners of container 71. First beveled members 73 extend inwardly and downwardly from a predetermined position above bottom member 13 and terminate on bottom member 13 adjacent to the corresponding lower corner.

Second set of beveled members 75 is disposed in respective slots 29 along side walls 15 and 17 of container 71 for reinforcing the respective regions of transition between side walls 15 and 17 and bottom member 13 between first rib members 27. Second beveled members 75 extend inwardly and downwardly from a predetermined position above bottom member 13 and terminate on bottom member 13 adjacent to the corresponding side walls 15 and 17 in much the same manner as first beveled members 73.

Figure 14:
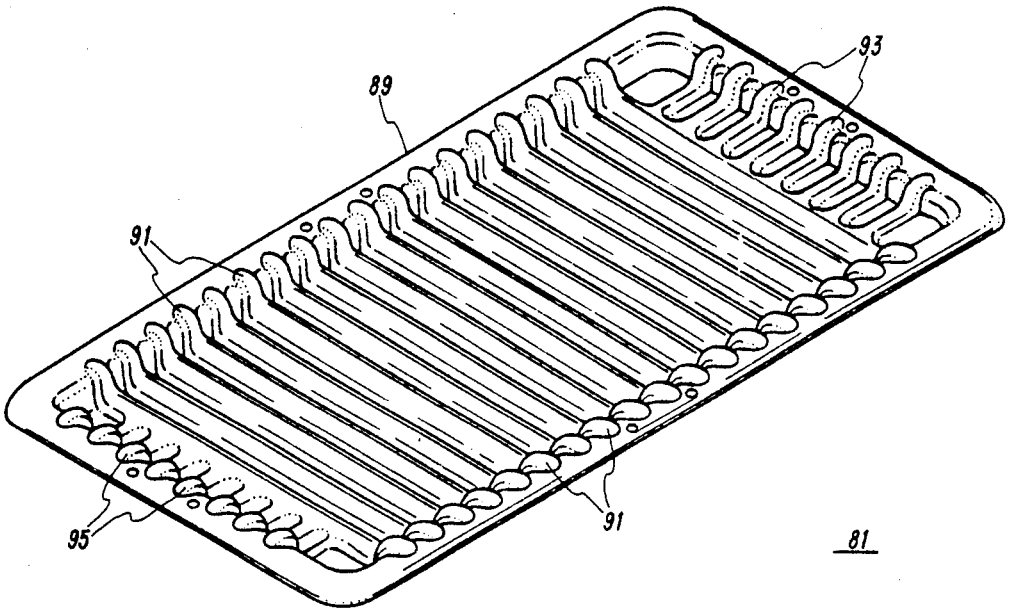
FIG. 14 is a perspective view of a third embodiment of the container according to the present invention.
Figure 14:
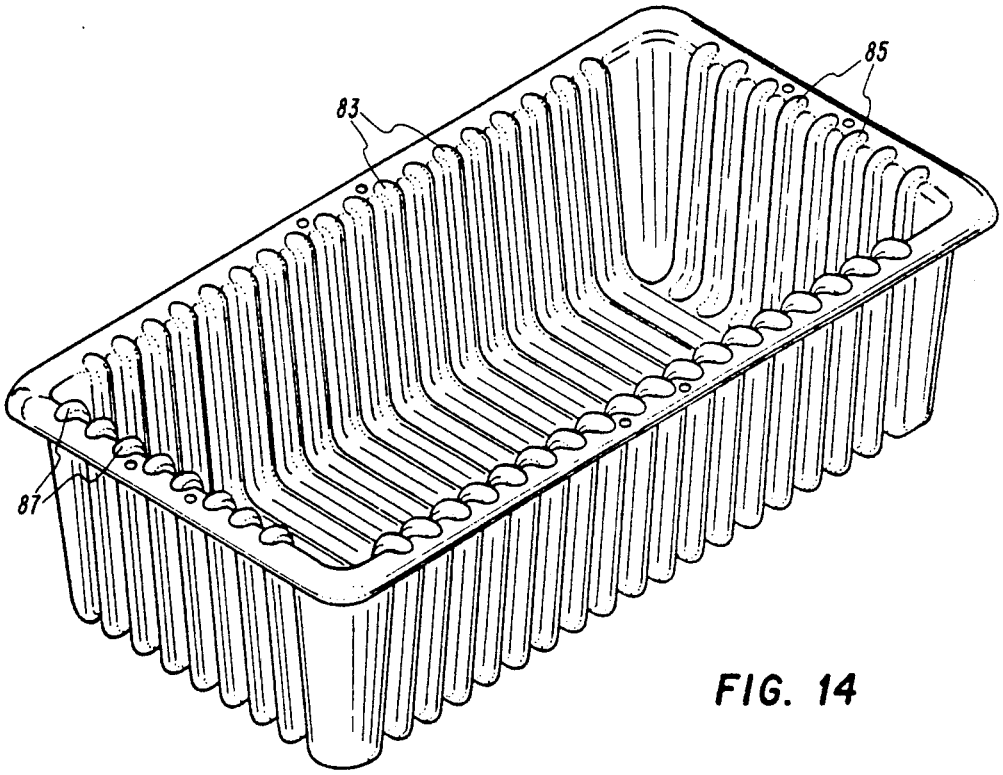

Referring to FIG. 14, a third embodiment of a container 81 according to the present invention is depicted. Container 81 is substantially the same as container 11 described above with reference to FIGS. 1–12, except that first set of rib members 83 disposed on the respective inner surfaces of container 81 are spaced apart at substantially equal distances instead of being arranged in cooperating pairs, as are first rib members 27. Likewise, second and third sets of rib members 85 and 87 disposed on the respective inner surfaces of container 81 are spaced much more closely together than the corresponding second and third sets of rib members 31 and 35 so that adjacent rib members of second and third sets of rib members 85 and 87 are spaced apart at a distance substantially equal to the width of each rib member, as measured along the transverse axis of container 81.

Cover member 89 is substantially the same as the corresponding cover member 41 associated with container 11, except that cover member 89 has fourth, fifth and sixth sets of rib members 91, 93 and 95 disposed on the respective inner surfaces of cover member 89 which are complementary with respective first, second and third sets of rib members, 83, 85 and 87 of container 81, as clearly shown in FIG. 14. Adjacent rib members of fourth set of rib members 91 are spaced apart at substantially equal distances on cover member 89, instead of being arranged in cooperating pairs as are fourth set of rib members 57. Fifth and sixth sets of rib members 93 and 95 are spaced substantially closer together than their counterpart fifth and sixth sets of rib members 59 and 61, so that the spacings between adjacent rib members of fifth and sixth sets of rib members 93 and 95 are substantially equal to the width of each such rib member, as measured along the transverse axis of cover member 89.

Figure 15:
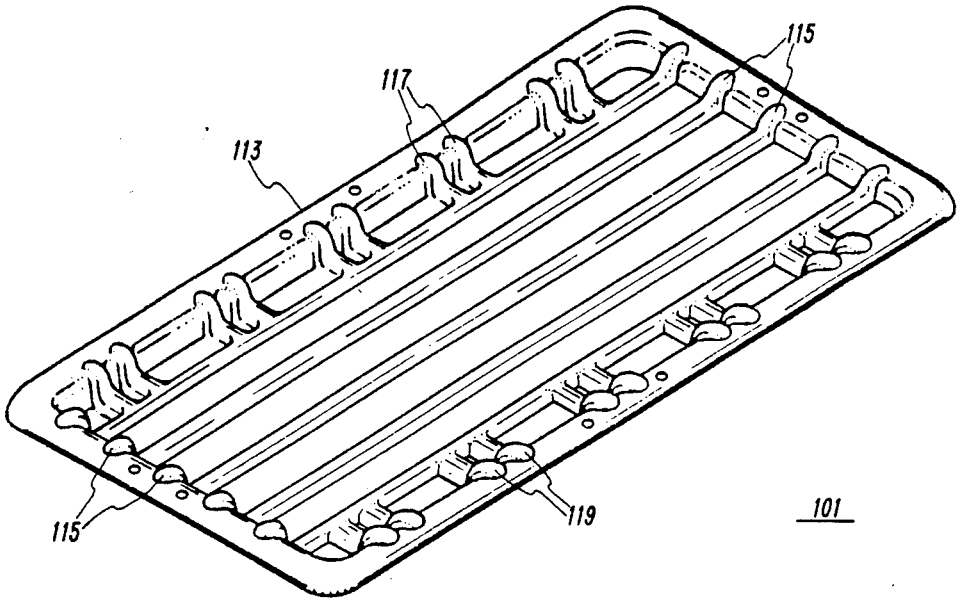
FIG. 15 is a perspective view of a fourth embodiment of the container according to the present invention.
Figure 15:
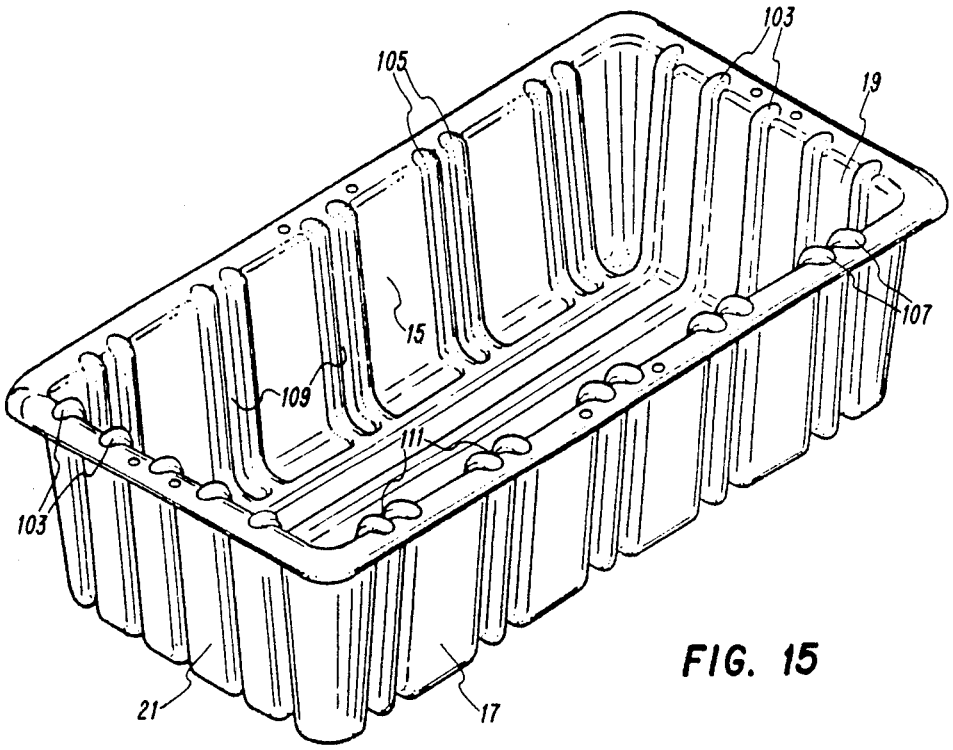

Referring to FIG. 15, a fourth embodiment of a container 101 according to the present invention has a first set of rib members 103 extending vertically along substantially the entire height of first end wall 19, longitudinally across a bottom member 13 and vertically along substantially the entire height of second end wall 21. First rib members 103 terminate by blending into rim member 23 adjacent to the respective intersections of rim member 23 with end walls 19 and 21.

A second set of rib members 105 are arranged in cooperating pairs at predetermined intervals along the inner surface of first side wall 15. Second rib members 105 extend vertically along substantially the entire height of side wall 15 and partially inwardly across bottom member 13 and terminate at the respective intersections on bottom member 13 with a particular one of first set of rib members 103 which is closest to side wall 15. A third set of rib members 107 are disposed in cooperating pairs at predetermined intervals along the inner surface of second side wall 17. Third rib members 107 extend vertically along substantially the entire height of side wall 17 and partially inwardly across bottom member 13 and terminate at the respective intersections on bottom member 13 with the particular one of first set of rib members 103 which is closest to side wall 17. Slots 109 and 111 are defined by each cooperating pair of rib members of the respective second and third sets of rib members 105 and 107 for receiving a divider or the like in much the same manner as previously described with reference to FIGS. 2 and 8. Cover member 113 has fourth, fifth and sixth sets of rib members 115, 117 and 119 which are complementary with respective first, second and third sets of rib members 103, 105 and 107 for being positioned in registration with the respective complementary rib members 103, 105 and 107 when cover member 113 is positioned to cover the enclosure of container 101.

Figure 16:
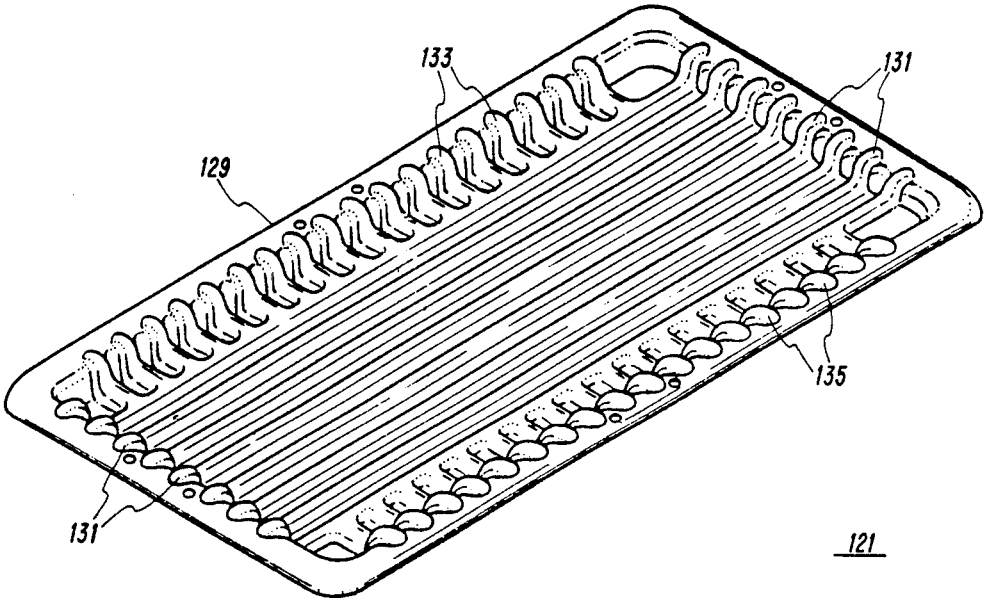
FIG. 16 is a perspective view of a fifth embodiment of the container according to the present invention.
Figure 16:
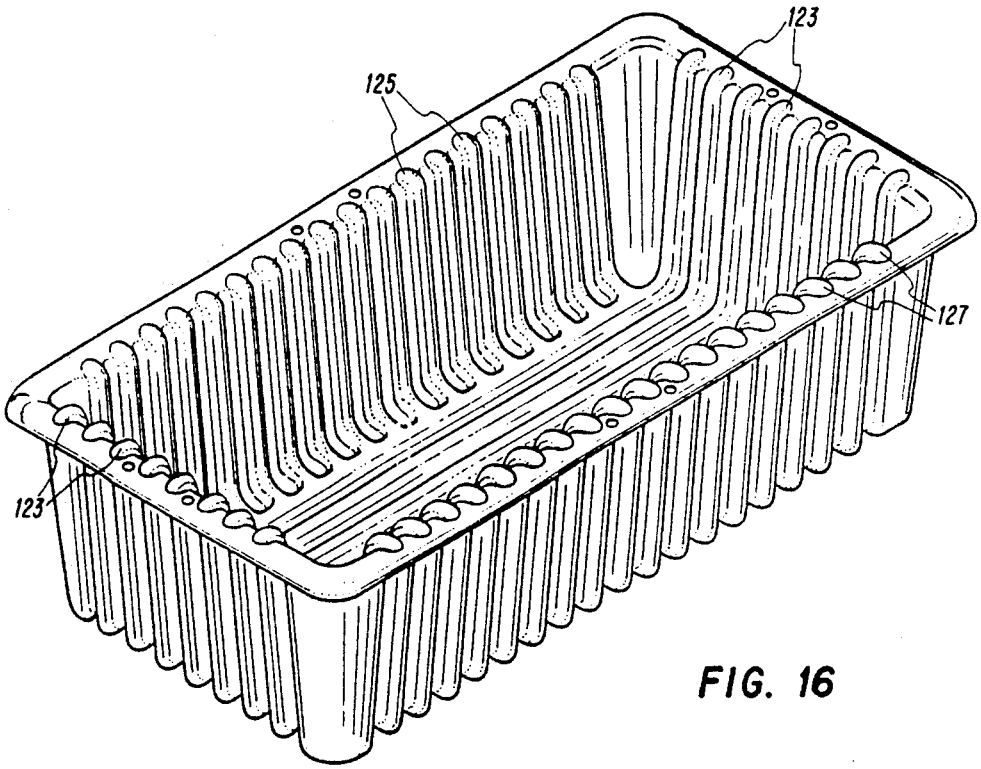

Referring to FIG. 16, a fifth embodiment of a container 121 according to the present invention is depicted. Container 121 is substantially the same as container 101 described with reference to FIG. 15, except that the rib members of first set of rib members 123 of container 121 are spaced substantially closer together than first set of rib members 103 on container 101, so that the spacing between adjacent rib members 123 is substantially the same as the width of each rib member 123, as measured along the transverse axis of container 121, and second and third sets of rib members 125 and 127 of container 121 are spaced apart at substantially equal distances along respective side walls 15 and 17, instead of being arranged in cooperating pairs of rib members, as are second and third sets of rib members 105 and 107 of container 101. Cover member 129 has fourth, fifth and sixth sets of rib members 131, 133 and 135 which are complementary with respective first, second and third sets of rib members 123, 125 and 127, for being placed in registration with respective complementary rib members of container 121 when cover member 129 is positioned to cover the enclosure of container 121.

Figure 17:
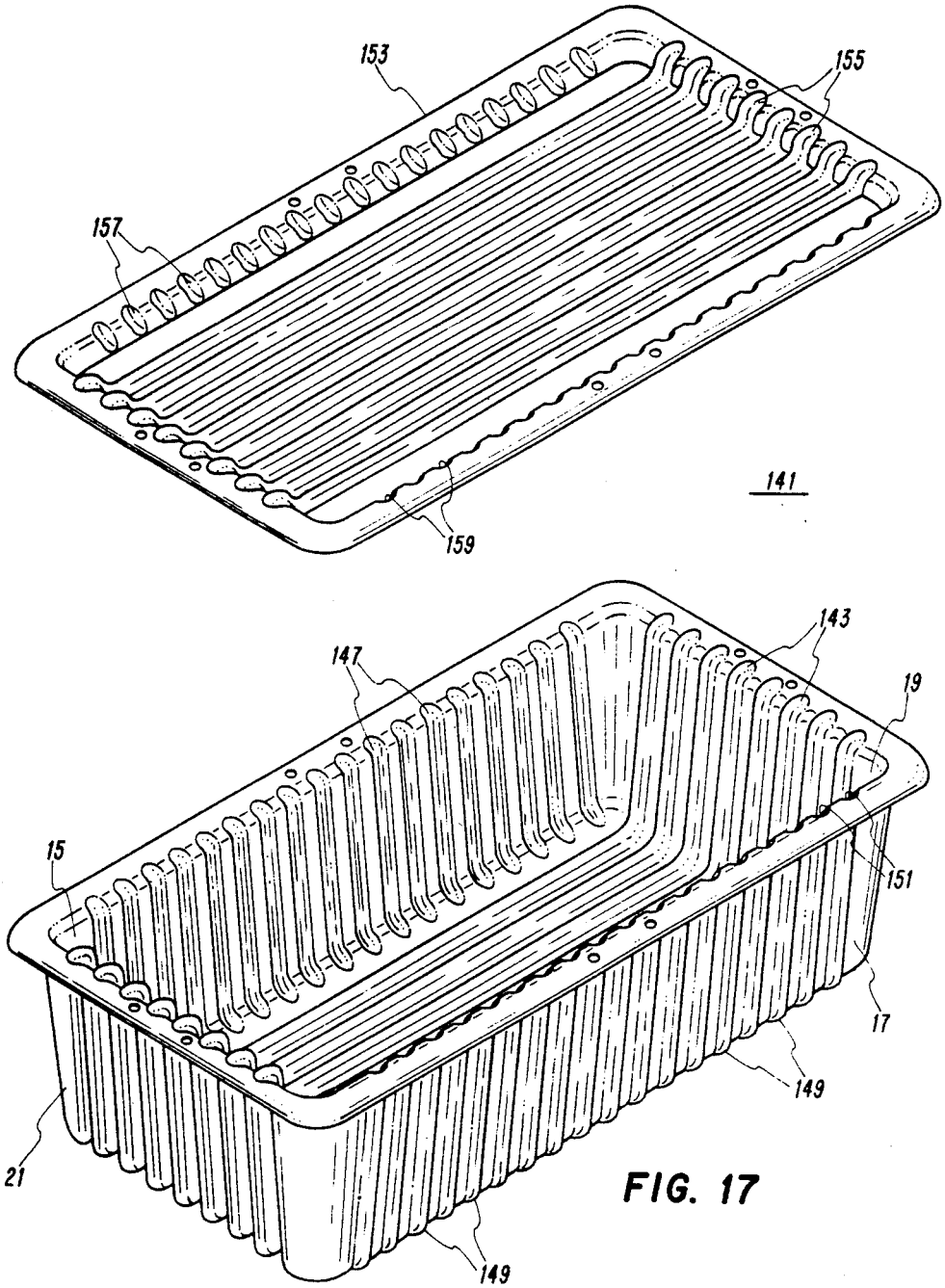
FIG. 17 is a perspective view of a sixth embodiment of the container according to the present invention.

Referring to FIG. 17, a sixth embodiment of a container 141 according to the present invention has a first set of rib members 143 extending vertically along substantially the entire height of a first end wall 19, longitudinally along bottom member 13 and vertically along substantially the entire height of a second opposite end wall 21. First rib members 143 are disposed on the respective inner surfaces of container 141. A second set of rib members (not shown) extends vertically on an outer surface of side wall 15, along substantially the entire height of side wall 15. The second rib members are blended into rim member 23 adjacent to the intersection of rim member 23 and side wall 15 and into bottom member 13 adjacent to the intersection of bottom member 13 and side wall 15. The second rib members define corresponding grooves 147 in the respective inner surfaces of container 141. A third set of rib members 149 extends vertically on an outer surface of side wall 17, along substantially the entire height of side wall 17 and blends into rim member 23 adjacent to the intersection of rim member 23 and side wall 17 and into bottom member 13 adjacent to the intersection of bottom member 13 and side wall 17. Third rib members 149 define corresponding grooves 151 in the respective inner surfaces of container 141. Cover member 153 has fourth, fifth and sixth sets of rib members 155, 157 and 159 which are complementary with respective first, second and third sets of rib members 143, 145 and 149 for being placed in registration with the respective complementary rib members of container 141 when cover member 153 is positioned to cover the enclosure of container 141.

Figure 18:
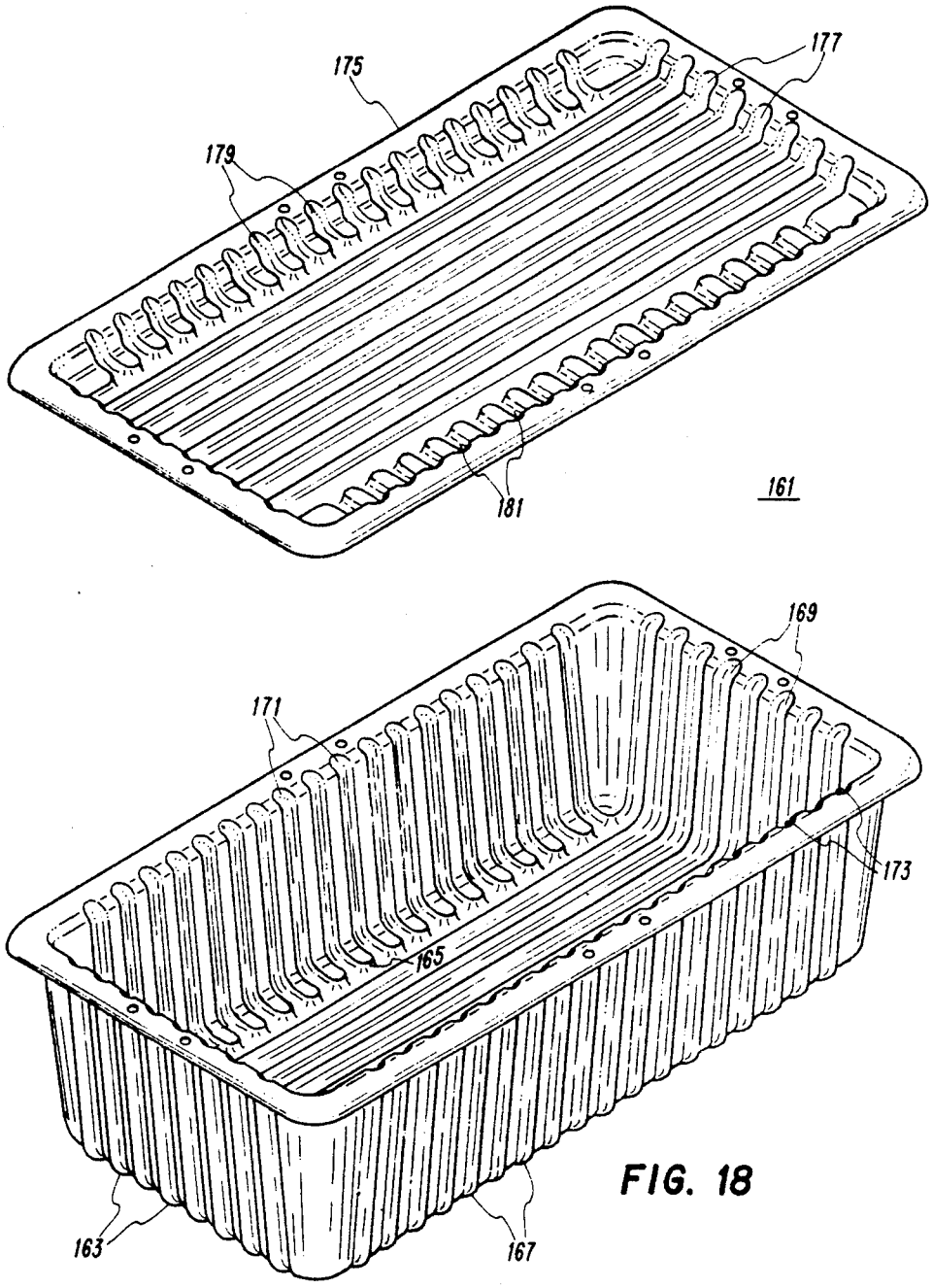
FIG. 18 is a perspective view of a seventh embodiment of the container according to the present invention.

Referring to FIG. 18, a seventh embodiment of a container 161 according to the present invention is depicted. Container 161 is substantially the same as container 81 shown in FIG. 14, except that container 161 has first, second and third sets of rib members 163, 165 and 167 which are disposed on respective outer surfaces of container 161, instead of respective inner surfaces, as are the counterpart rib members of container 81 shown in FIG. 14. Rib members 163, 165 and 167 define corresponding grooves 169, 171 and 173 on the respective inner surfaces of container 161. Cover member 175 has fourth, fifth and sixth sets of rib members which are complementary with respective first, second and third sets of rib members 163, 165 and 167 for being placed in registration with respective complementary rib members of container 161 when cover member 175 is positioned to cover the enclosure of container 161. Fourth, fifth and sixth rib members of cover member 175 define corresponding grooves 177, 179 and 181 on the respective inner surfaces of cover member 175.

The container of the present invention solves many of the problems associated with prior art containers used for storing and transporting letter mail and other flat articles. Specifically, the container according to the present invention provides a lightweight, yet structurally strong container for storing and transporting letter mail and an associated cover member which can be securely attached to the container to protect the contents thereof. The container according to the present invention has the capacity to receive a divider to maintain the integrity of pre-sorted mail within the container and complementary structural features to enable multiple containers to be vertically stacked in a stable arrangement and nested when the containers are empty and their respective covers removed, so as to save storage space. The use of a translucent material to form the container has the advantage of allowing the contents to be viewed without having to remove the cover member from the container. The container is versatile enough to be used on mail conveyor systems where mail is first sorted, for transporting sorted mail to the desired destinations and by mail carriers at the destinations to distribute individual articles of mail to the respective addresses. The durability and strength of the container enables it to handle large and heavy loads of mail and the lightweight feature provides a substantial savings in transportation costs, which is typically a function of weight.

Various embodiments of the invention have now been described in detail. Since changes in and modifications to the above-described embodiments may be made without departing from the nature, spirit and scope of the invention, the invention is not to be limited to said details, except as set forth in the appended claims.

What is claimed is:

1. A container for storing relatively flat articles such as letters and the like, comprising:

a bottom member and four walls extending upwardly from said bottom member and interconnected to form an enclosure for receiving said articles, said bottom member having a width greater than the respective lengths of the articles to be stored in said container and a length which is substantially greater than the respective thicknesses of said articles;

a first set of rib members dispoesd at respective predetermined positions on said container and extending vertically along substantially the entire height of a first one of said walls, horizontally across said bottom member and vertically along substantially the entire height of a second one of said walls oppositely positioned from said first wall;

a second set of rib members disposed at respective predetermined positions on said container and extending vertically along substantially the entire height of a third wall and partially inwardly along said bottom member and terminating at respective intersections on said bottom member with a particular one of said first set of rib members which is closest to said third wall;

a third set of rib members disposed at respective predetermined positions on said container and extending vertically along substantially the entire height of a fourth wall oppositely positioned from said third wall and partially inwardly along said bottom member, said third set of rib members terminating at respective intersections on said bottom member with a particular one of said dfirst set of rib members which is closest to said fourth wall; and a rim member extending horizontally outward from said four walls around the permimeter of said container.

2. The container according to claim 1 wherein said container has a substantially rectangular shape and said four walls are comprised of a pair of oppositely positioned first and second side walls extending longitudinally along said container and a pair of oppositely positioned first and second end walls extending transversely along said container, the respective intersections being adjacent ones of said walls, the respective intersections between each of said walls and said bottom member and the respective intersections between each of said walls and said rim member defining respective curved surfaces to provide respective areas of transition therebetween, to enhance the strength and rigidity of the container.

3. The container according to claim 2 further including a removable cover member for covering the enclosure of said container to protect the articles stored therein, said cover member comprising:

a base portion, four walls extending upwardly from said base portion and a lip member extending horizontally outward from said walls around the perimeter of the cover member for being positioned in facing contact with the rim member of the container when the cover member is positioned to cover the enclosure of the container;

a fourth set of rib members disposed at respective predetermined positions on said cover member and extending vertically along substantially the entire height of a fifth wall, horizontally across said base portion and vertically along substantially the entire height of a sixth wall oppositely positioned from said fifth wall;

a fifth set of rib members disposed at respective predetermined positions on said cover member and extending vertically along substantially the entire height of a seventh wall and partially inwardly along said base portion and terminating at respective intersection on said base portion with a particular one of said fourth set of rib members which is closest to said seventh wall; and a sixth set of rib members disposed at respective predetermined positions on said cover member and extending vertically along substantially the entire height of an eighth wall and partially inwardly along said base portion and terminating at respective intersections on said base portion with a particular one of said fourth set of rib members which is closest to said eighth wall, said fourth, fifth and sixth sets of rib members being complementary with the respective first, second and third sets of rib members of said container and being substantially in registration therewith when said cover member is positioned to cover the enclosure of said container.

4. The container according to claim 3 wherein said cover member has a substantially rectangular shape and the four walls of said cover member are comprised of a pair of oppositely positioned third and fourth side walls extending longitudinally along said cover member and a pair of oppositely positioned third and fourth walls extending transversely across said cover member, the respective intersections between adjacent ones of the walls of said cover member, between each of the walls of said cover member and said base portion and between each of the walls of said cover member and said lip member defining respective curved surfaces to provide respective areas of transition therebetween, to enhance the strength and rigidity of said cover member.

5. The container according to claim 4 wherein said container is comprised of a lightweight plastic material formed using a thermoforming process, said bottom member, four walls, first, second and third rib members and rim member being formed as an integral unit and said cover member being formed as an integral unit.

6. The container according to claim 4 wherein said first set of rib members extends vertically along substantially the entire height of the first side wall, transversely across said bottom member and vertically along substantially the entire height of the second side wall and said second and third sets of rib members extend vertically along substantially the entire heights of the respective first and second end walls and partially inwardly along said bottom member and terminating at the respective intersections on said bottom member with respective ones of said first set of rib members which are closest to the respective first and second end walls.

7. The container according to claim 6 wherein adjacent ones of said first set of rib members cooperate to define respective slots therebetween, for receiving divider means for partitioning the container into selected compartments to maintain the integrity of pre-sorted articles stored therein.

8. The container according to claim 7 wherein said first rib members are arranged in respective pairs at predetermined locations on said container so that the width of the slot defined by each corresponding pair of rib members is substantially less than the spacing between adjacent ones of said slots.

9. The container according to claim 7 wherein adjacent ones of said first rib members are spaced apart at substantially equal intervals along said container, the width of the slots between adjacent first rib members being substantially equal to the width of each of the first rib members.

10. The container according to claim 6 wherein said fourth set of rib members extend vertically along substantially the entire height of said third side wall, transversely across said base portion and vertically along substantially the entire height of the fourth side wall and said fifth and sixth sets of rib members extend vertically along substantially the entire heights of the respective third and fourth end walls and partially inwardly along said base portion and terminating at the respective intersections on said base portion with respective ones of said fourth set of rib members which are closest to the respective first and second end walls.

11. The container according to claim 5 wherein said first set of rib members extends vertically along substantially the entire height of the first end wall, longitudinally along said bottom member and vertically along substantially the entire height of the second end wall and said second and third sets of rib members extend vertically along substantially the entire heights of the respective first and second side walls and partially inwardly across said bottom member and terminating at respective intersections on said bottom member with the respective ones of said first set of rib members which are closest to the respective first and second side walls.

12. The container according to claim 11 wherein adjacent ones of said second and third sets of rib members cooperate to define respective slots therebetween, said slots being adapted to receive divider means for partitioning the container into selected compartments to maintain the integrity of the pre-sorted articles stored therein.

13. The container according to claim 11 wherein said fourth set of rib members extends vertically along substantially the entire height of said third end wall, longitudinally along said base portion and vertically along substantially the entire height of the fourth end wall and said fifth and sixth sets of rib members extend vertically along substantially the entire heights of the respective third and fourth side walls and partially inwardly along said base portion and terminating at the respective intersections on said base portion with respective ones of said fourth set of rib members which are closest to the respective third and fourth side walls.

14. The container according to claim 4 wherein said rim member has a first pair of openings formed therein adjacent to respective central portions of each of the four walls of the container and said lip member of said cover member has a corresponding second pair of openings formed therein adjacent to respective central portions of each of the four walls of said cover member, each of said second pair of openings being substantially in registration with a corresponding first pair of openings for receiving a tie member or the like for securing said rim member to said lip member.

15. The container according to claim 4 wherein said first, second and third rib members are disposed on respective inner surfaces of said container and define corresponding grooves on respective outer surfaces and said fourth, fifth and sixth rib members are disposed on respective inner surfaces of the walls of said cover member and on an upper surface of the base portion of said cover member and define corresponding grooves on the respective outer surfaces of the walls of said cover member and on a lower surface of the base portion of said cover member, said grooves formed by said first, second and third rib members on a first container for mating with respective ones of said fourth, fifth and sixth rib members on a second container to allow multiple containers to be vertically stacked in a relatively stable configuration.

16. The container according to claim 15 wherein multiple containers are nestable when empty and with the respective cover members removed by inserting the bottom member of a first one of said containers into the enclosure of a second one of said containers so that the grooves on the outer surfaces of the first container mate with the complementary rib members on the inner surfaces of the second container.

17. The container according to claim 4 wherein said first, second and third rib members are disposed on respective outer surfaces of said container and define corresponding grooves on respective inner surfaces of said container and said fourth, fifth and sixth rib members are disposed on respective outer surfaces of the walls of said cover member and on a lower surface of the base portion of said cover member and define corresponding grooves on the respective inner surfaces of the walls of said cover member and on an upper surface of the base portion of said cover member, said first, second and third rib members on a first container for mating with respective grooves defined by said fourth, fifth and sixth rib members on the cover member of a second container to allow multiple containers to be vertically stacked in a relatively stable configuration.

18. The container according to claim 17 wherein multiple containers are nestable when empty and with the respective cover members removed by inserting the bottom of a first one of said containers into the enclosure of a second one of the containers so that the rib members on the outer surfaces of the first container mate with complementary grooves on the inner surfaces of the second container.

19. The container according to claim 4 wherein the respective confluences of adjacent side walls and end walls of the container with said bottom member form respective lower corners of said container, said respective lower corners each having a relatively flat first beveled member extending inwardly and downwardly from a predetermined position above said bottom member and terminating on said bottom member adjacent to the corresponding lower corner, for reinforcing the lower corners of said container.

20. The container according to claim 19 wherein relatively flat second beveled members are disposed between adjacent ones of selected rib members on said container, said second beveled members extending inwardly and downwardly from a predetermined position above said bottom member and terminating on said bottom member adjacent to the respective intersections of the corresponding walls of said container with said bottom member to reinforce the areas of transition between the corresponding walls of said container and said bottom member.

21. The container according to claim 4 wherein said container is comprised of a translucent material to enable the contents thereof to be viewed when multiple containers are stacked vertically without the necessity of removing the corresponding cover on the container.

22. The container according to claim 4 wherein said first, second and third rib members are blended into the rim member adjacent to the respective intersections of the rim member with the corresponding walls of said container and said fourth, fifth and sixth rib members are blended into the lip member of said cover member adjacent to the respective intersections of the lip member with the corresponding walls of said cover member.

23. A container for storing relatively flat articles such as letters and the like, comprising:

a bottom member, first and second oppositely positioned side walls and first and second oppositely positioned end walls, said side walls and said end walls extending upwardly from said bottom member and interconnected to form an enclosure for receiving said articles, said bottom member having a width greater than the respective lengths of the articles to be stored in said container and a length which is substantially greater than the respective thicknesses of said articles;

a first set of rib members extending vertically along substantially the entire height of the first side wall, transversely across said bottom member and vertically along substantially the entire height of the second wall;

second and third sets of rib members extending vertically along substantially the entire heights of the respective first and second end walls and partially inwardly along said bottom member and terminating at respective intersections on said bottom member with respective ones of said first set of rib members which are closest to the respective first and second end walls; and a rim member extending horizontally outward from said side walls and said end walls around the perimeter of said container, said rim member, side walls, end walls and bottom member being formed as an integral unit.

24. The container according to claim 23 further including a removable cover member for covering the enclosure of the container to protect the articles stored in the container, said cover member comprising:

a base portion, oppositely positioned third and fourth side walls and oppositely positioned third and fourth end walls, said side walls and said end walls extending upwardly from said base portion, and a lip member extending horizontally outward from said side walls and said end walls around the perimeter of the cover member for being positioned in facing contact with the rim member of the container when the cover is positioned to cover the enclosure of the container, said base portion, said side walls, said end walls and said lip member being formed as an integral unit;

a fourth set of rib members extending vertically along substantially the entire height of the third side wall, transversely across said base portion and vertically along substantially the entire height of the fourth side wall;

fifth and sixth sets of rib members extending vertically along substantially the entire heights of the respective third and fourth end walls of said cover member and partially inwardly along said bottom portion and terminating at respective intersections on said bottom portion with respective ones of said fourth set of rib members which are closest to the respective third and fourth end walls of said cover member, said fourth, fifth and sixth sets of rib members being complementary with the respective first, second and third sets of rib members and being substantially in registration therewith when said cover member is positioned to cover the enclosure of said container.

25. A container for storing relatively flat articles such as letter mail and the like, comprising:

a bottom member, first and second oppositely positioned side walls and first and second oppositely positioned end walls, said side walls and said end walls extending upwardly from said bottom member and interconnected to form an enclosure for receiving said articles, said bottom member having a width greater than the respective lengths of the articles to be stored in said container and a length which is substantially greater than the respective thicknesses of said articles;

a first set of rib members extending vertically along substantially the entire height of the first end wall, longitudinally along said bottom member and vertically along substantially the entire height of the second end wall;

second and third sets of rib members extending vertically along substantially the entire heights of the first and second respective side walls and partially inwardly across said bottom member and terminating at respective intersections on said bottom member with the respective ones of said first set of rib members which are closest to the respective first and second side walls; and a rim member extending horizontally outward from said side walls and said end walls around the perimeter of said container to facilitate handling and transport of the container, said bottom member, rim member, side walls, end walls and first, second and third sets of rib members being formed as an integral unit.

26. The container according to claim 25 further including a removable cover member for covering the enclosure of the container to protect the articles stored in the container, said cover member comprising:

a base portion, oppositely positioned third and fourth side walls and oppositely positioned third and fourth end walls, said side walls and said end walls extending upwardly from said base portion, and a lip member extending horizontally outward from said side walls and said end walls around the perimeter of the container for being positioned in facing contact with the rim member of the container when the cover member is positioned to cover the enclosure of the container, said base portion, said side walls, said end walls and said lip member being formed as an integral unit;

a fourth set of rib members extending vertically along substantially the entire height of the third end wall, longitudinally along said base portion and vertically along substantially the entire height of the fourth end wall;

fifth and sixth sets of rib members extending vertically along substantially the entire heights of the respective third and fourth side walls and partially inwardly across said base portion and terminating at the respective intersections on said base portion with respective ones of said fourth set of rib members which are closest to the respective third and fourth side walls of the cover member.

27. A container for storing relatively flat articles such as letters and the like, comprising:

a bottom member and four walls extending upwardly from said bottom member and interconnected to form an enclosure for receiving said articles, said bottom member having a width greater than the respective lengths of the articles to be stored in said container and a length which is substantially greater than the respective thicknesses of said articles;

a rim member extending horizontally outward from said walls around the perimeter of said container to facilitate handling and transport of the container, said bottom member, said four walls and said rim member being formed as an integral unit;

a first set of rib members extending vertically along substantially the entire height of a first one of said walls, horizontally across said bottom member and vertically along substantially the entire height of a second one of said walls oppositely positioned from said first wall, said first set of rib members being disposed on respective inner surfaces of said first and second walls and said bottom member;

a second set of rib members extending vertically on an outer surface of a third wall along substantially the entire height of said third wall, said second set of rib members being blended into said rim member adjacent to the intersection of said rim member and said third wall and into said bottom member adjacent to the intersection of said bottom member and said third wall; and a third set of rib members extending vertically on an outer surface of a fourth wall opposite from said third wall along substantially the entire height of said fourth wall, said third set of rib members being blended into said rim member adjacent to the intersection of said rim member and said fourth wall and into said bottom member adjacent to the intersection of said bottom member and said fourth wall.

28. The container according to claim 27 further including a removable cover member for being positioned to cover the enclosure of the container to protect the articles stored in the container, said cover member comprising:

a base portion, four walls extending upwardly from said base portion and a lip member extending horizontally outward from said walls around the perimeter of the cover member for being positioned in facing contact with the rim member of the container when the cover member is positioned to cover the enclosure of the container, said base portion, said walls and said lip member being formed as an integral unit;

a fourth set of rib members extending vertically along substantially the entire height of a fifth wall, horizontally along said base portion and vertically along substantially the entire height of a sixth wall oppositely positioned from said fifth wall, said fourth set of rib members being disposed on respective inner surfaces of said fifth and sixth walls and on an upper surface of said base portion;

a fifth set of rib members extending vertically on an outer surface of a seventh wall along substantially the entire height of said seventh wall, said fifth set of rib members being blended into said lip member adjacent to the intersection between said lip member and said seventh wall and into said base portion adjacent to the intersection of said base portion and said seventh wall; and a sixth set of rib members extending vertically on an outer surface of an eighth wall opposite from said seventh wall along substantially the entire height of said eighth wall, said sixth set of rib members being blended into said lip member adjacent to the intersection of said lip member and said eighth wall and into said base portion adjacent to the intersection of said baase portion and said eighth wall.

29. The container according to claim 28 wherein said second and third rib members define corresponding grooves on respective inner surfaces of the respective third and fourth walls of the container, said grooves being adapted to receive divider means for partitioning the container into selected compartments to maintain the integrity of presorted articles stored therein.

30. The container according to claim 28 wherein said first rib members define corresponding grooves on respective outer surfaces of said container and said second and third rib members define corresponding grooves on respective inner surfaces of said container, said fourth rib members define corresponding grooves on respective outers surfaces of the walls of said cover member and on a lower surface of the base portion of said cover member and said fifth and sixth rib members define corresponding grooves on respective inner surfaces of said cover member, said grooves formed by said first rib members on a first container for mating with respective ones of said fourth rib members on the cover member of a second container and the second and third rib members of said first container for mating with respective grooves defined by said fifth and sixth rib members of the cover member on said second container to allow multiple containers to be vertically stacked in a relatively stable configuration.

31. The container according to claim 30 wherein multiple containers are nestable when empty and with the respective cover members removed by inserting the bottom member of a first container into the enclosure of a second container so that the rib members of the first container mate with the complementary grooves on the second container and the grooves on the first container mate with the complementary rib members on the second container.

* * * * *